US005417094A

United States Patent [19]

Chisum

[11] Patent Number: 5,417,094

[45] Date of Patent: May 23, 1995

[54] APPARATUS FOR LIFTING, HOLDING, CENTERING, MEASURING WHILE REPAIRING DAMAGED VEHICLES

[76] Inventor: Finis L. Chisum, Rte. 5, Box 267, Claremore, Okla. 74017

[21] Appl. No.: 120,902

[22] Filed: Sep. 13, 1993

[51] Int. Cl.[6] ..... B21D 1/12

[52] U.S. Cl. ..... 72/34; 33/608; 72/705

[58] Field of Search ..... 72/705, 457, 34; 33/608

[56] References Cited

U.S. PATENT DOCUMENTS

| | | | |
|---|---|---|---|
| Re. 31,636 | 7/1984 | Chisum | 72/305 |
| 3,888,100 | 6/1975 | Chisum | 72/305 |
| 4,242,803 | 1/1981 | Dory | 33/288 |
| 4,329,784 | 5/1982 | Bjork | 33/608 |
| 4,463,937 | 8/1984 | Celette | 269/17 |
| 4,506,449 | 3/1985 | Aldrich | 33/608 |
| 4,603,570 | 8/1986 | Dehn | 72/305 |
| 5,054,307 | 10/1991 | Wisner | 72/705 |
| 5,058,286 | 10/1991 | Chisum . | |
| 5,189,899 | 3/1993 | Hsu | 72/705 |
| 5,207,002 | 5/1993 | Humblet | 33/288 |

FOREIGN PATENT DOCUMENTS

| | | | |
|---|---|---|---|
| 2637205 | 3/1990 | France | 72/705 |
| 1323163 | 7/1973 | United Kingdom | B21D 1/12 |

*Primary Examiner*—Lowell A. Larson
*Attorney, Agent, or Firm*—Head & Johnson

[57] ABSTRACT

Apparatus for use in conjunction with an automobile body and frame straightening platform system includes a plurality of moveable jacks which are attachable to the vehicle for raising the vehicle above the platform and moving it so as the longitudinal center line of the vehicle is coincident with the longitudinal center line of the platform system wherein measuring devices will be clearly indicative of the extent of damage to a vehicle and its appropriate repair according to the manufacture's specifications.

12 Claims, 12 Drawing Sheets

Fig. 11
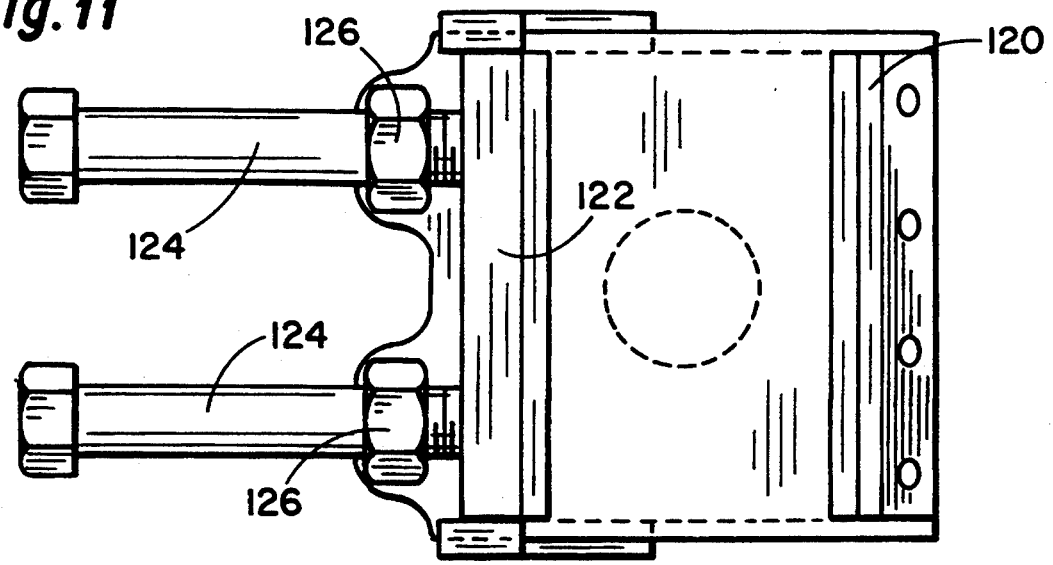
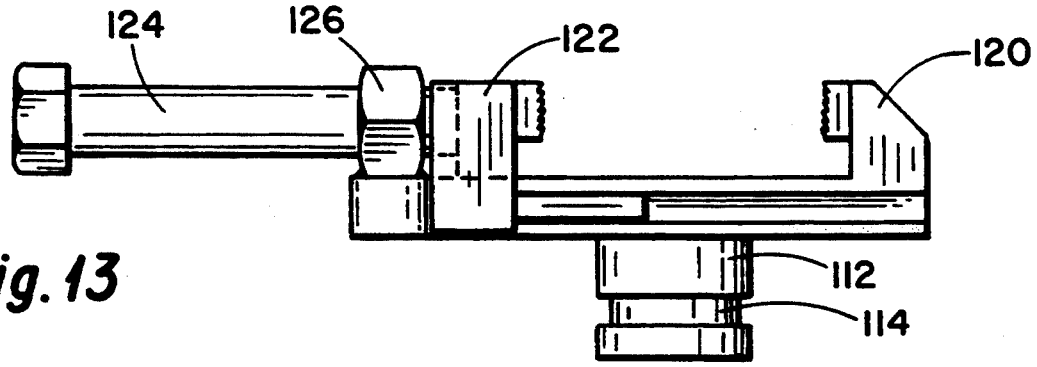
Fig. 13
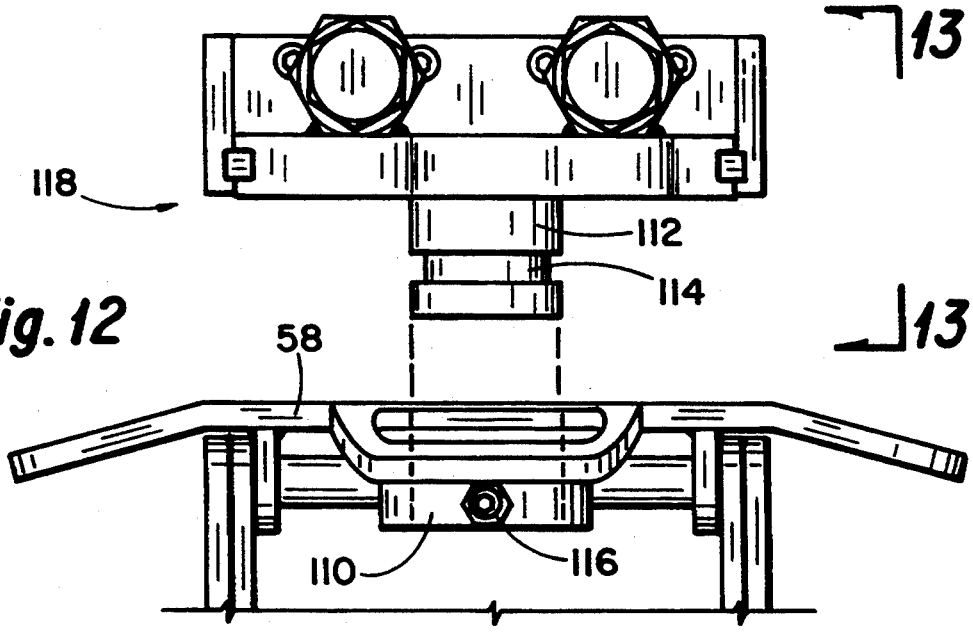
Fig. 12

APPARATUS FOR LIFTING, HOLDING, CENTERING, MEASURING WHILE REPAIRING DAMAGED VEHICLES

BACKGROUND OF THE INVENTION

This invention relates generally to vehicle frame straightening equipment: and, more particularly, a fixture assembly for lifting, holding, centering, measuring while repairing damaged vehicles. The invention is an improvement upon U.S. Pat. No. 5,058,286 which is incorporated herein by reference.

In recent years, automotive vehicles have been constructed almost entirely with unitized bodies. That is, the entire frame and body of the vehicle are a unit assembly. This form of vehicle construction has been found to be economical, lighter in weight and can equal or exceed the strength of conventional frames or chassis. The repair of unitized vehicle bodies has typically involved the use of frame straightening equipment such as that shown in U.S. Pat. No. 3,630,066 and U.S. Pat. No. Re. 31,636 sometimes called "rack type" equipment. The measurement of the amount of correction required to restore the vehicle to its original manufacturer's specification has involved either a separate "checking bench" such as described in U.S. Pat. No. 4,242,803 or gauging systems which were adapted to be supported by the vehicle such as shown in U.S. Pat. Nos. 4,731,936; 4,329,784; and 4,442,608.

Other prior art devices have shown apparatus wherein a platform provides securing means for rigidly securing a vehicle upon a straightening bench to be subject to the straightening operation which permit longitudinal and transverse movement of the vehicle upon the platform such as shown in U.K. Patent No. 1,323,163; U.S. Pat. No. 4,463,937; and U.S. Pat. No. 4,603,570.

Other devices, called "bench type" apparatus, are those where the vehicle is driven over the apparatus as opposed the "rack type" where the vehicle is driven upon the apparatus.

SUMMARY OF THE INVENTION

The purpose of this invention is to provide an all-purpose vehicle body frame straightening and general repair system that will simplify and make the process more efficient and productive. This is accomplished by a rack type platform system that:

1) Will accept a vehicle and raise it above the platform to a comfortable working height for access to the underside;
2) Will include means to center the raised vehicle upon the platform to perform measurements to determine the extent of damage and needed repair to restore the vehicle to its original manufacturer's specifications;
3) Will become a substantial part of the measuring facilities requiring minimal devices to assist the repair person in restoring a damaged vehicle;
4) Will include pulling equipment along with rigid vehicle fastening and back-up means to restore the vehicle; and
5) Will provide holding mechanism to align new body or other vehicle parts in position for reattachment to the vehicle.

To achieve these purposes are improvements to the inventions found in U. S. Pat. No. 5,058,286 in the vehicle jack mechanism that includes adjustable clamps and/or interchangeable tools to receive and secure to the jack mechanism the vehicle parts to be repaired or installed. The jack mechanism is capable of collapsing to height low enough to secure the jack to parts of the vehicle such as a frame rail or a pinch weld; raise the vehicle to a suitable working height from the floor or the platform system relative to a measuring datum plane formed by the platform system itself; measure the extent of damage relative to the vehicle's original specifications; and then monitor measurements during the repair of the vehicle while equal and opposite forces are being applied.

The invention further has as its object the ability to hold and position new and used replacement parts to a collision damaged vehicle for connection, e.g., by welding, to the vehicle, along with a measuring device, to insure proper location of the part relative to the vehicle before it is and during the process of installing the parts to the vehicle.

The jack system herein described has the capability of collapsing low enough to be placed under a car and thus, extend the car upward to a suitable working height in one lift cycle. Restraining means are provided for connection to the jack and the platform system to secure the vehicle solidly enough to hold a vehicle in the measurement position while the body and frame of the collision damaged vehicle is being repaired by pulling or pushing forces of several tons. In addition, by raising the vehicle above the platform, the measurement systems for determining when the damaged vehicle has been returned to its specified dimensions are more readily available and visible to the operator.

BRIEF DESCRIPTION OF THE DRAWINGS

FIG. 11 is a top view of an alternate form of vehicle body clamp mechanism attachment for the top of the holding jack.

FIG. 12 is a side elevation view of the alternate embodiment shown in FIG. 11.

FIG. 13 is a side elevation view taken along the line 13—13 of FIG. 12.

DETAILED DESCRIPTION OF THE PREFERRED EMBODIMENT

Before explaining the present invention in detail, it is to be understood that the invention is not limited in its application to the details of the construction and arrangement of parts illustrated in the accompanied drawings. The invention is capable of other embodiment and of being practiced or carried out in a variety of ways. It is to be understood that the phraseology and terminology employed herein is for the purpose of the description and not of limitation.

Figure 1:
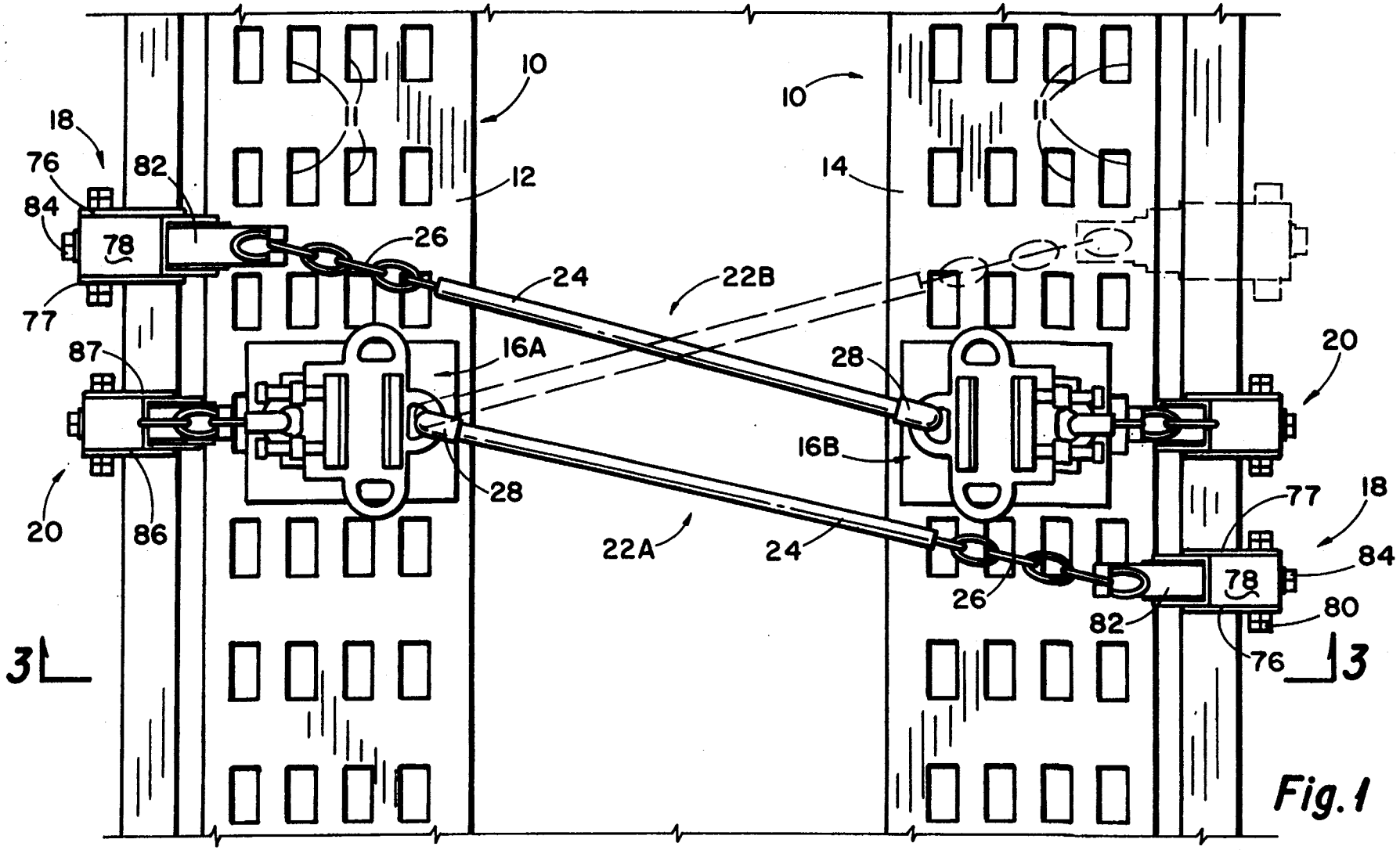
FIG. 1 is a top plan view of the holding jack system of this invention.
Figure 2:
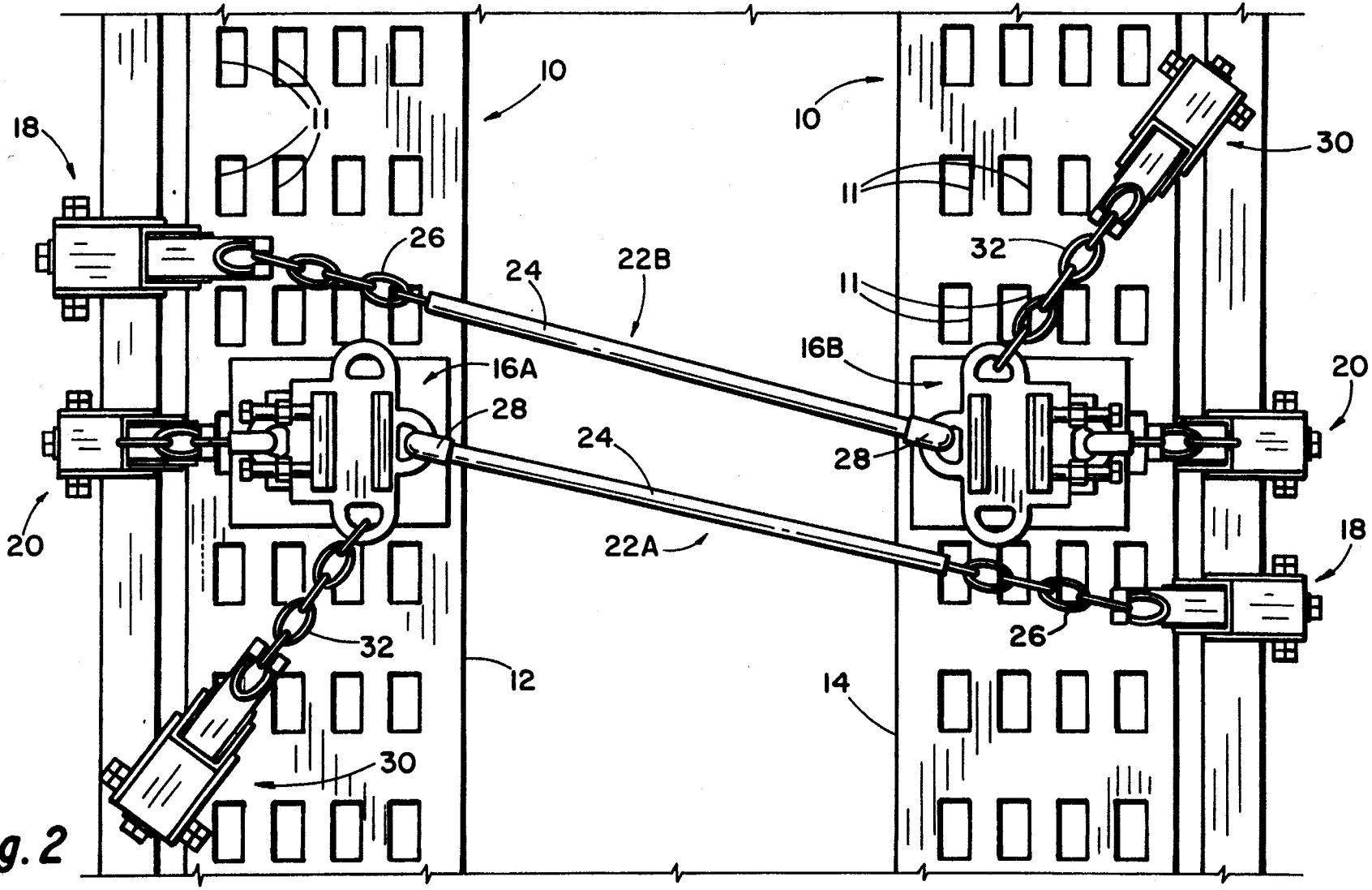
FIG. 2 is a top plan view similar to FIG. 1 with a modified form of back-up holding system for use in repairing collision damaged vehicles.

FIGS. 1 and 2 are top plan views of a portion of a vehicle support platform such as shown in U.S. Pat. No. 5,058,286 with the details of the platform itself and the vehicle repair devices omitted for the purposes of clarity.

The dual track platform system is generally indicated by the numeral 10 having treadways 12 and 14 upon which the vehicle will be first driven and supported. The holding system of the invention comprises two pairs of a jack and clamp assembly generally designated by the numeral 16 (16A and 16B) and hereinafter described in greater detail. One pair is located rearwardly of the vehicle and the other forwardly, preferably at undamaged locations, yet provide stability. This system further includes primary slack adjustors/back-up means, generally designated by the numeral 18 and secondary slack adjustors generally designated by the numeral 20. Between the holding jacks 16 and their primary slack adjustor are tie rod hooks generally designated by the numeral 22 (22A and 22B) each of which comprises a solid member 24 and adjusting chain 26, the solid portion including a hook 28 for interconnection with the holding jack. Although the jacks and associated holding systems 22 are shown in FIGS. 1 and 2 as being in a parallel relationship, it is to be understood that this is just one of a variety of positions the elements may be placed. For example, they may be crossed as shown by the dotted line position.

Figure 4:
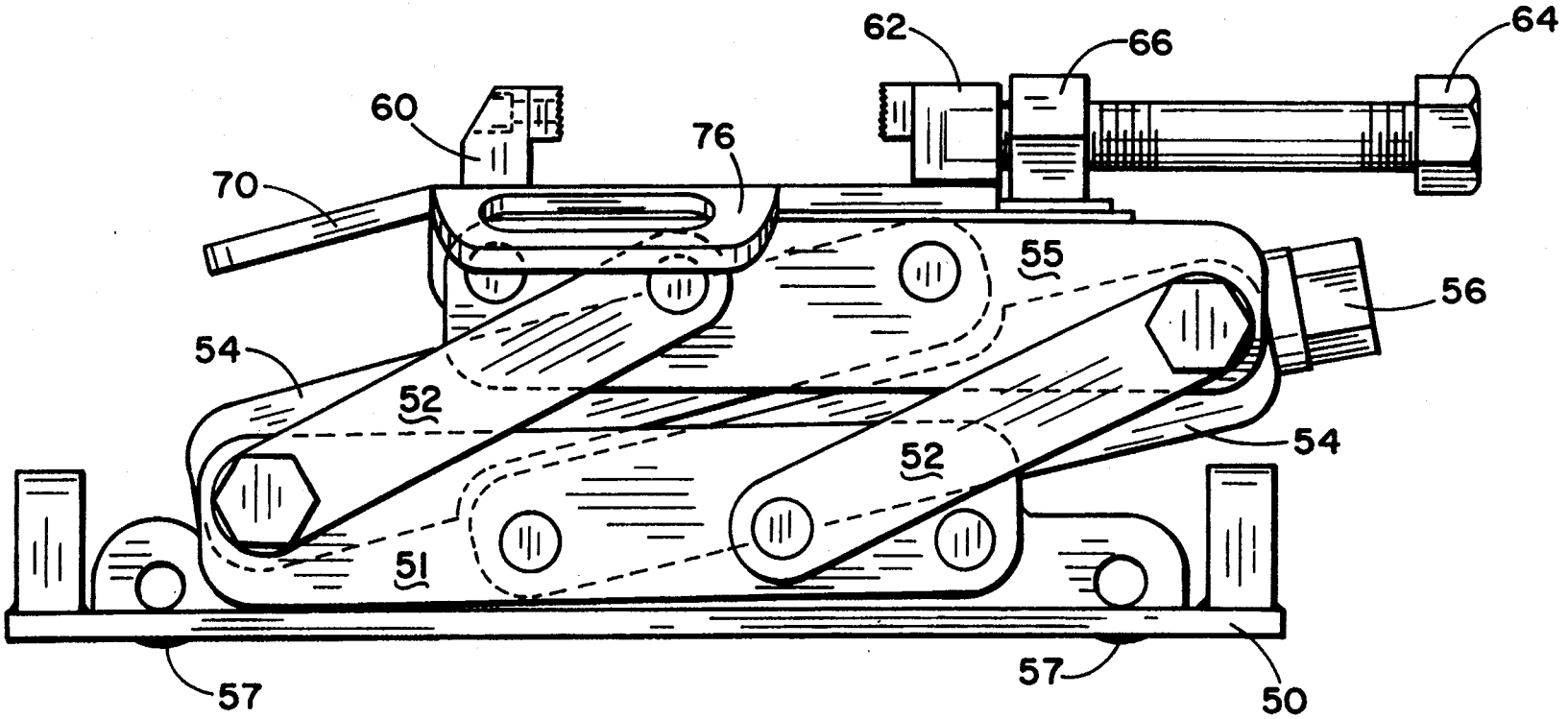
FIG. 4 is a side elevation view of the holding jack in the collapsed position.
Figure 5:
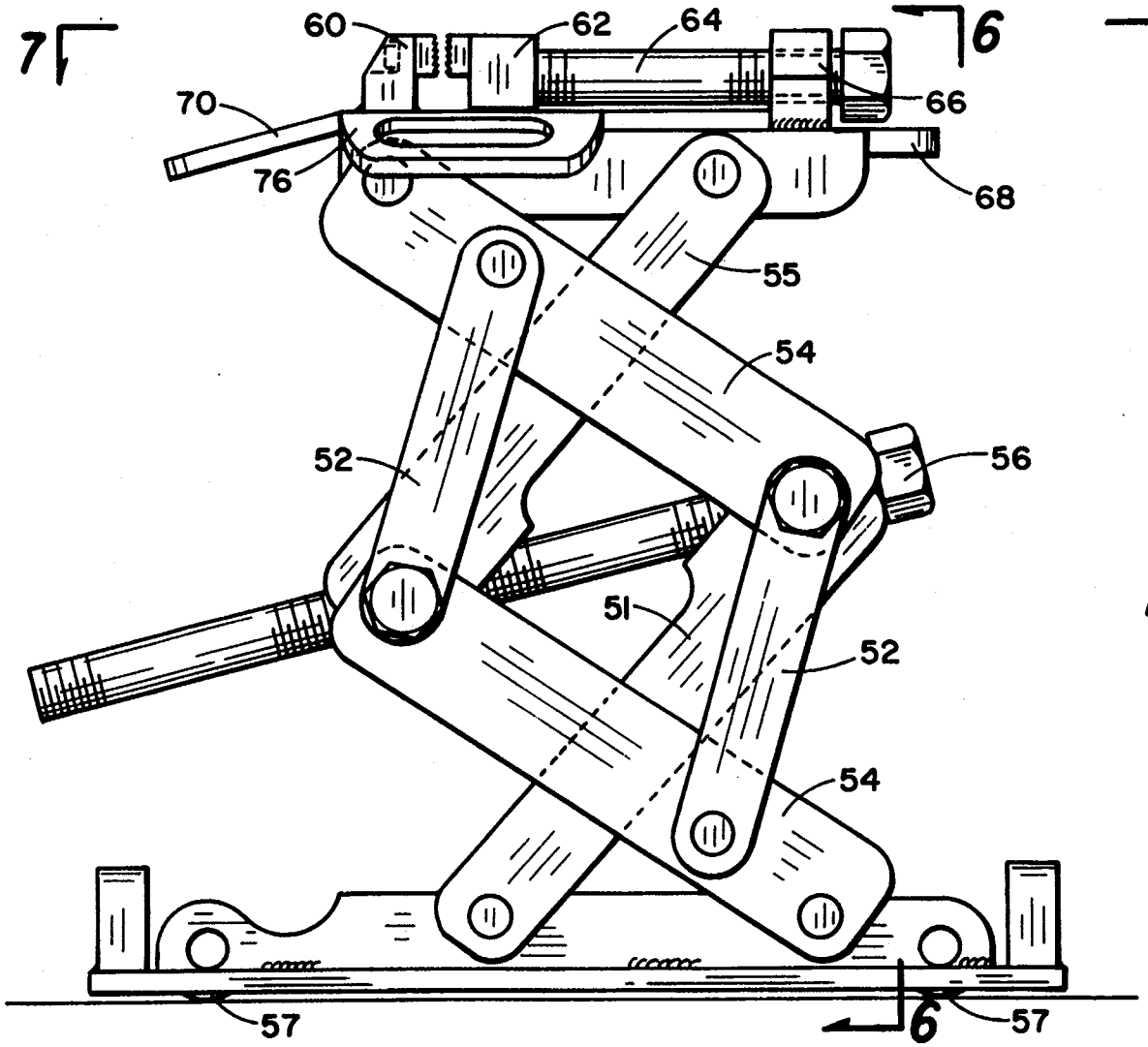
FIG. 5 is a side elevation view of the holding jack in the expanded or raised position.

FIG. 2 represents an additional embodiment of the invention which involves the use of tertiary slack adjustors/back-ups generally designated by the numeral 30 which interconnect with the holding jack system by way of adjusting chain 32. Slack adjustors interconnect with the treadways either at the sides as shown herein or can interconnect with openings formed in the treadway. The slack adjustors perform an important function in restraining or as a back-up to the vehicle during the straightening operation. Another function is to maintain the vehicle in its position relative to the fixed measuring datum planes in order that the operator may immediately determine the amount of correction required to restore the vehicle to its original manufactured specification. Those specifications are of a type as shown in FIGS. 4 and 5 of U.S. Pat. No. 5,058,286 and described therein.

Figure 3A:
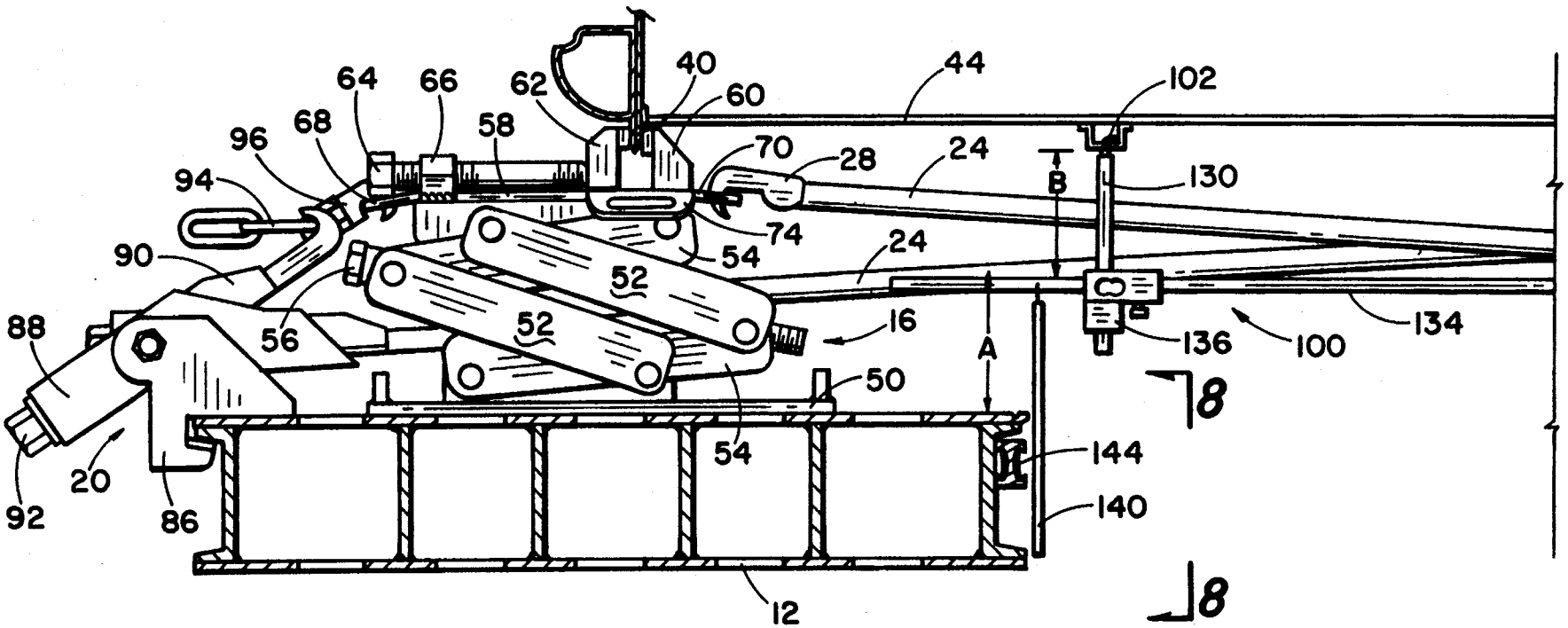
FIGS. 3A and 3B are continued front plan views of the holding jack system of FIG. 1 taken along the line 3—3 thereof.
Figure 3B:
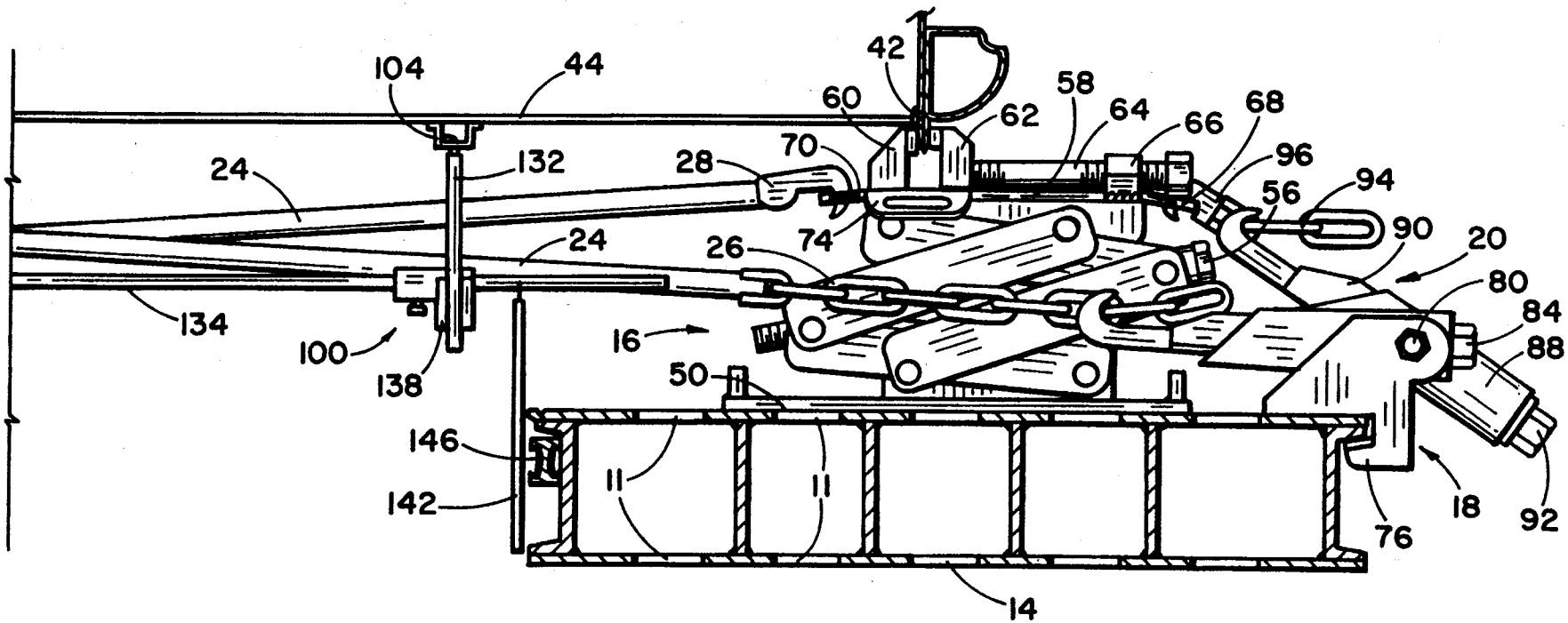
Figure 6:
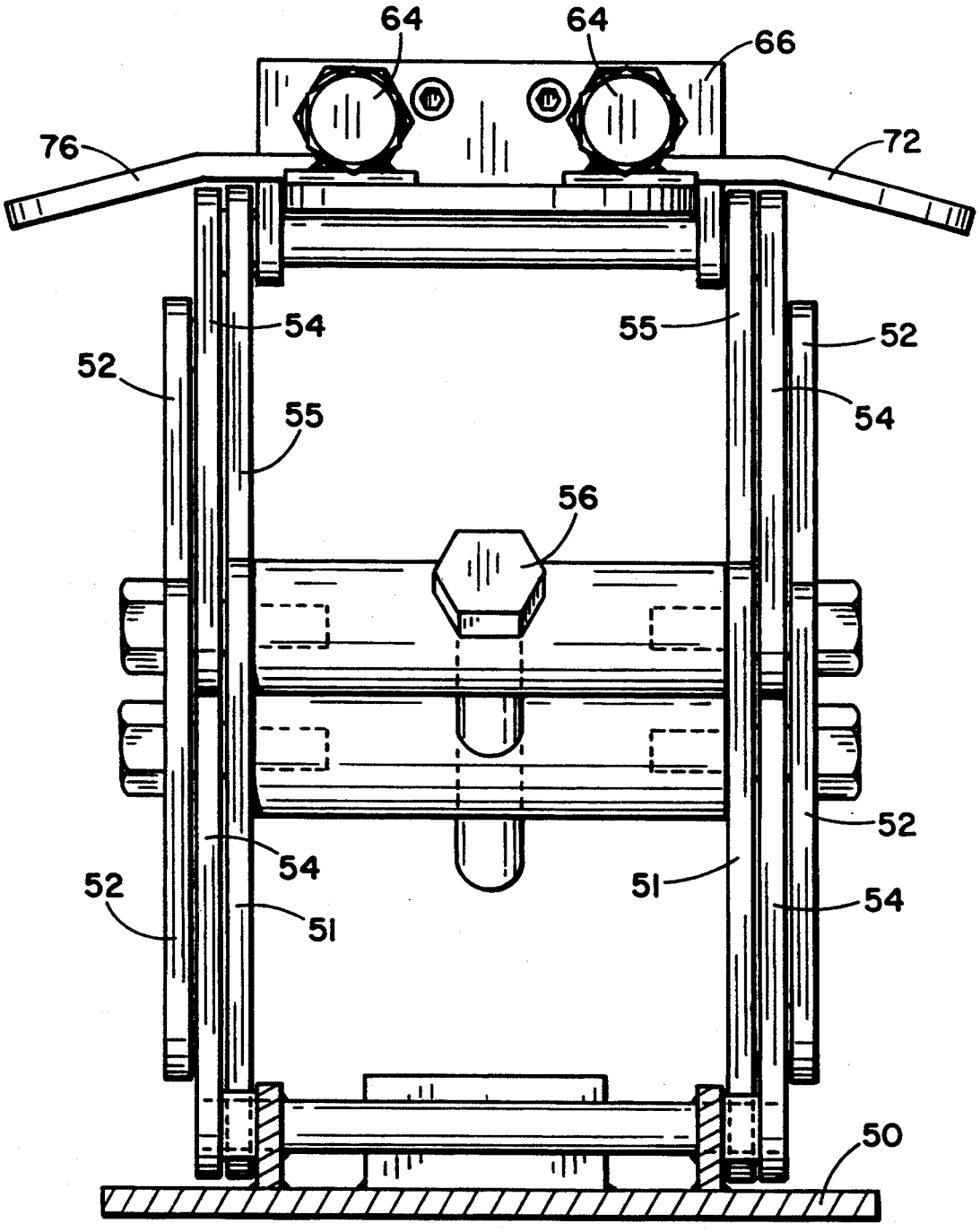
FIG. 6 a side elevation view of the holding jack taken along the line 6—6 of FIG. 5.
Figure 7:
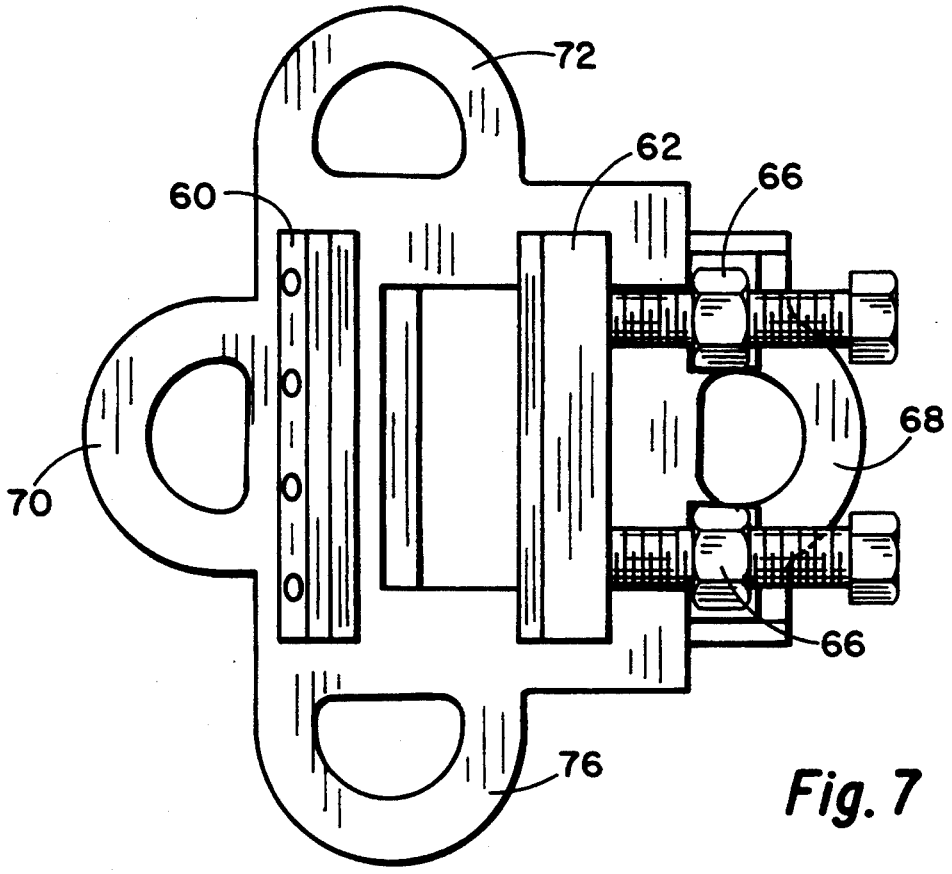
FIG. 7 is a top view of the vehicle clamp mechanism formed as a part of the holding jack taken along the line 7—7 of FIG. 5.

Referring now to FIGS. 3A and 3B, additional detail of the holding jack system and one form of gauging system is disclosed. In these views, the holding jack system is shown attached to the transverse pinch welds 40 and 42 of the vehicle unibody 44 to hold the vehicle in proper position above the platform system 10 and its treadways 12 and 14. The jack 16 itself, being also shown in FIGS. 4, 5 and 6, comprises a base plate 50 on each side of which is a pair of outer jack arms 52 and inner jack arms 54 which outer and inner arms are raised and lowered by rotation of screw Atop the jack is a platform 58 containing a fixed jaw 60 and a moveable jaw 62 which clamp in FIG. 3A onto pinch weld by the action of clamp screw 64 when rotated relative to fixed nut 66. The upper plate 58 may include an outer extension member 68, and inner extension member 70 and side extensions 72 and 74 only one of which is shown in FIG. 3A.

Referring now to FIG. 3B, the primary slack adjustor includes a side anchoring slot and bracket 76 to which housing 78 is pivotally attached around shaft 80. Slack adjustor hook and sleeve 82 is connected slack adjusting bolt 84 for movement inwardly and outwardly, the hook being interconnected with adjusting chain 26 formed as a part of the solid rod member 24.

Referring back to FIG. 3A, the secondary slack adjustor 20 comprises a pair of side anchoring brackets 86 and 87 for attachment to the treadway 12. Pivotally connected to the brackets is slack adjusting housing 88 into which the slack adjustor and hook member 90 is slidable and adjustable by bolt 92. The slack adjustor and hook member 90 is connected to chain 94 which is interconnected by way of hook 96 to the outer extension 68 of the jack. Also, shown in FIGS. 3A and 3B is a measuring system generally designated by the numeral 100 that depends from fixturing members 102 and 104. The measuring system being hereinafter described in greater particularity.

FIGS. 4, 5, 6 and 7 represent different views of the holding jack of this invention. One additional embodiment includes the possibility of small rollers 57, four in number for stability to permit ease of movement of the jack along the treadways 12 and 14 during the use of the holding jack system when centering the vehicle to the measuring platform. FIG. 4 shows the jack in its collapsed position, while FIG. 5 shows the jack in the raised position.

Figure 10:
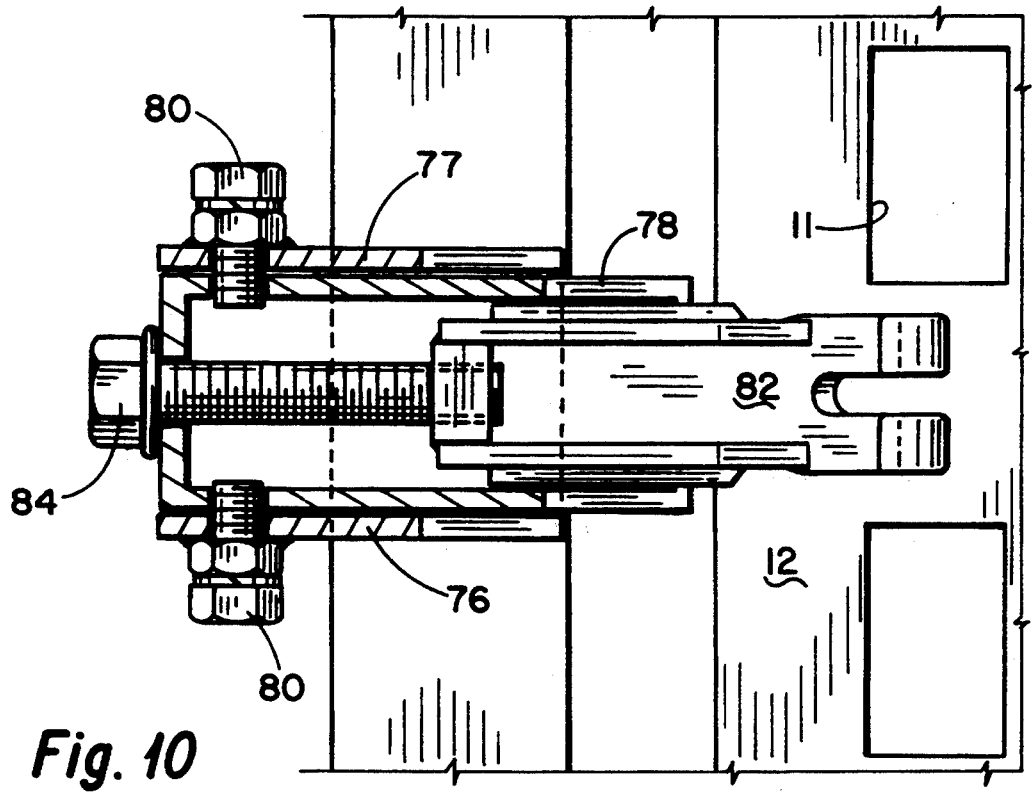
FIG. 10 is a top partially sectioned view of the slack adjustor taken along the line 10—10 of FIG. 9.
Figure 9:
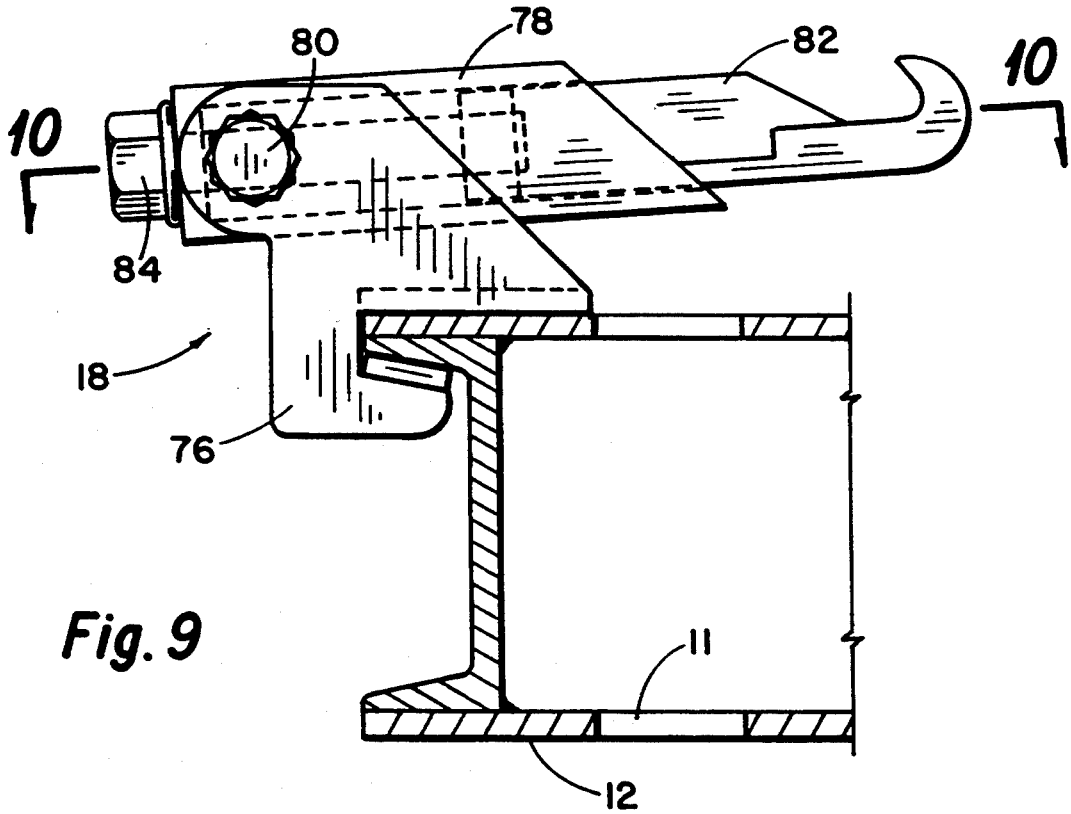
FIG. 9 side elevation view of the slack adjustor used in conjunction with this invention.

FIGS. 9 and 10 represent enlarged side and top views of a typical slack adjustor mechanism. Although some differences are shown in the type of slack adjustors as shown in FIGS. 3A and 3B, it is to be understood that all of the slack adjustors can be duplicative of the embodiment shown in FIGS. 9 and 10. That is, one design of slack adjustor may be utilized for the variety of positions whether it be the primary, secondary or tertiary adjustor.

FIGS. 11, 12 and 13 represent an alternate embodiment 5 of a removable clamping mechanism for attachment to the top of the jack 16. In this embodiment, the top of the jack platform 58 includes a sleeve 11O to receive cylindrical post 112 which has an indented portion 114. A lock screw the in the sleeve 110 will retain the clamp generally designated by the numeral 118 in fixed or rotatable position. The upper portion of the clamp is similarly constructed to that described heretofore and includes a fixed jaw 120, a moveable jaw 122 and one or more adjustment bolts 124 which operate through fixed nuts 126.

Figure 8:
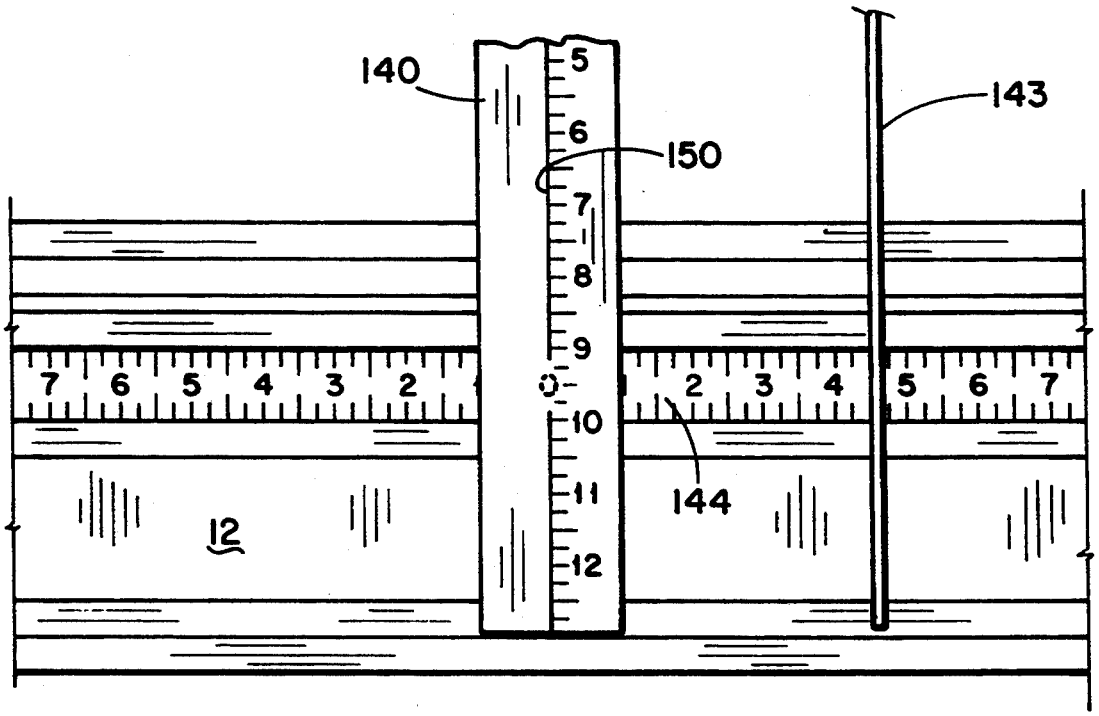
FIG. 8 is a partial side view of one form of centering-/measuring means taken along the lines 8—8 of FIG. 3A.

Referring now to FIG. 8 in conjunction with also FIGS. 3A and 3B and the measuring system 100 provides a means for the operator to not only center the vehicle on the platform system but to determine the extent of the damage in the vehicle. The measuring system comprises first and second depending arms 130 and 132. These arms are attached to horizontal gauge arm 134 by means of gauge brackets 136 and 138. Depending from the gauge rod 134 are vertical gauge members 140 and 142 which when used in conjunction with measuring tapes 144 and 146 respectively provide a ready reference to the operator of not only the relationship of the vehicle to the platform but also the extent of the damage to the vehicle as hereinafter described. In some instances, the measuring tapes 144 and 146 and its associated frames 145 and 147 can be made a part of a separate and portable or removable framework positioned within or atop the platform system or upon the floor. In the preferred embodiment, the depending measuring rods 140 and 142 are of a clear plastic providing a see-through concept for alignment of the center line 150. Another style would be a knife-edge scale 143 as shown in FIG. 8; the scales not vibrate.

Figure 14:
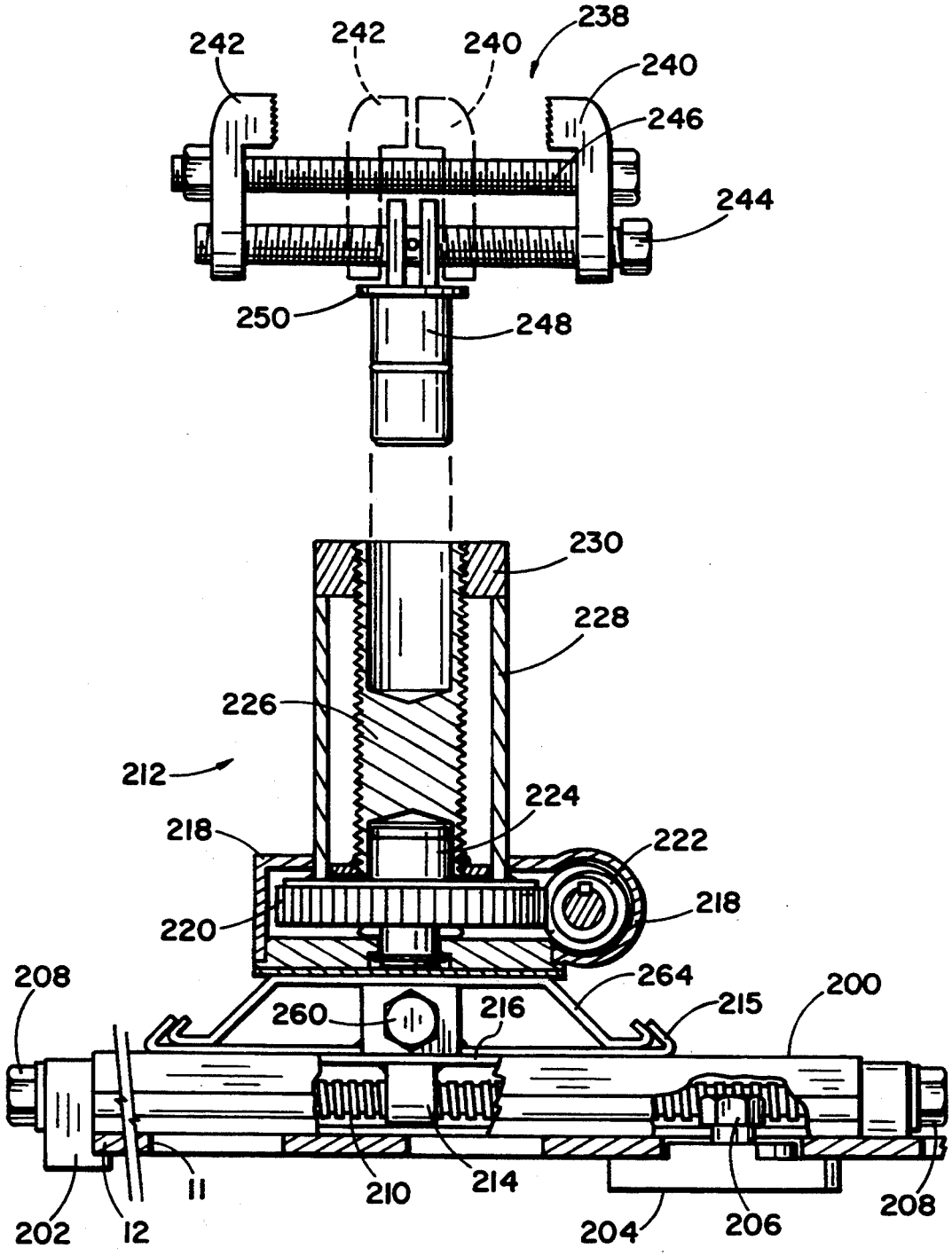
FIG. 14 is a side elevation view, partly cut away and exploded, which represents another form of holding jack for use with the platform system of this invention.
Figure 15:
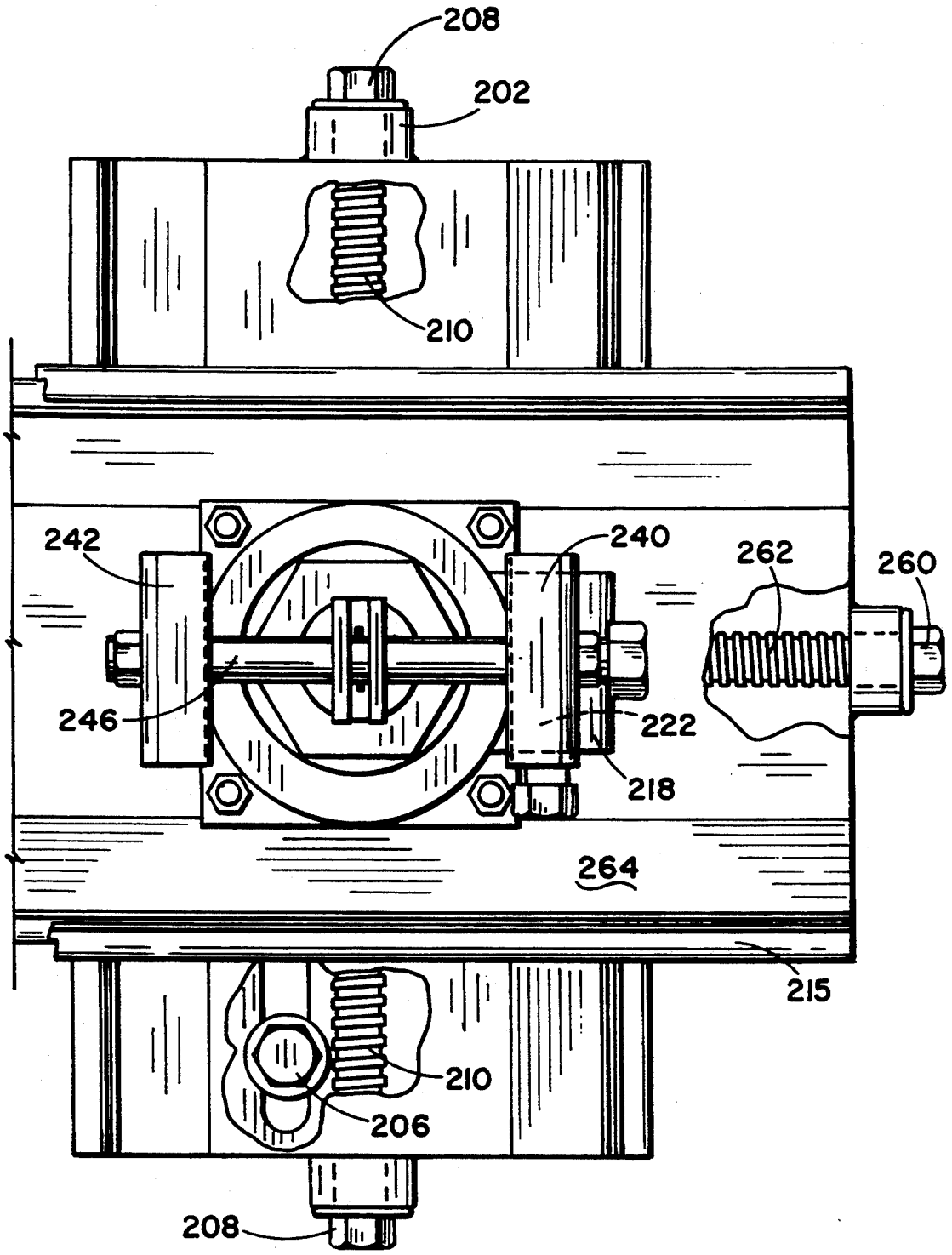
FIG. 15 is a top plan view of the holding jack of FIG. 14.

Referring now to FIGS. 14 and 15 wherein an alternate form of holding jack is described which is capable of movement along an imaginary X, Y, and Z axis. The jack comprises a base 200 which can be supported to a particular treadway 12 having openings 11 by a locking bracket 202 to the edge of the treadway. Other means of attaching the device to the treadway includes an extension locking nut 204 which is retained by bolt 206. By the rotation of adjusting bolt 208 which has acme threads 210, this will cause movement of the jack assembly generally designated by the numeral 212 to move to the left or the right in this view along the X axis. This occurs because the central nut 214 is attached to the assembly and moveable along a slot 216 formed as a part of the base 200. The vertical or Y axis components of the device include a worm gear housing 218 within which is worm gear 220 which is operated by the rotation of worm 222 found as a part of the housing 218. The worm gear shaft 224 is keyed to threaded shaft 226 which rotates within barrel 228 having at its upper end a nut 230. Rotation of shaft 224 and threaded shaft 226 will cause the barrel to rotate which as a result will allow threaded shaft 226 to move vertically upwardly or downwardly as the case may be. At the top of the threaded shaft is the vehicle clamp assembly generally designated by the numeral 228 which includes moveable jaws 240 and 242 by the rotation of bolt 244. The jaws are stabilized together by a threadless shaft 246 and thus, permit them to move inwardly and outwardly as shown by the dotted lines. The clamp assembly includes a shaft 248 and disk 250. Movement along the Z axis occurs by rotation of shaft 260 which rotates the acme threaded shaft 262 by reason of a nut, not shown, attached to the base plate 264. Clamp of the nature shown in FIGS. 14 and 15 is capable of holding vehicle parts, fenders, frame sections, inner panels, doors, etc., to be used to hold them in proper relationship to a damaged vehicle while these structural parts are being welded or otherwise secured to the vehicle or the device can be used as an alternative to the jack shown in the previous figures.

OPERATION

The vehicle to be repaired is positioned on the treadways 12 and 14 of the platform system 10. Jaw clamps 60 and 62 are connected to pinch welds 40 and 42 or other connectable portion of a vehicle. After both the forward and rearward pairs of clamps are in position, the vehicle is to be positioned on the platform system so that the longitudinal centerline of the vehicle matches the longitudinal centerline of the platform system integral measuring system. A primary slack adjustor 18 attached to the opposite of the treadway by rotating bolt 84 (see FIG. 3B). Rod 22 attached to the jack 16 with the chain 26 attached to the slack adjustor permits the vehicle to be pulled toward that side. Similar adjustments are made with all of the jacks 16 until the vehicle has been longitudinally and transversely centered on the platform. Once centered, the slack adjustors are tightened respectively and secondary slack adjustors 20 are attached and connected to the jack by means of hook 96, chain 94 and slack adjustment member 90 by rotation of bolt 92 in sleeve 88. This, along with any needed tertiary adjustors 30, provides a back-up when pulling forces will be applied to the vehicle for correction and thus, maintain the vehicle in the oriented position without movement on the treadway or platform system. Thus, the operator will always be able, in conjunction with a measuring system used to exactly tell whether or not the vehicle frame and body is being or has been straightened to the manufacturer's specifications.

When using a measuring system 100 as shown in FIGS. 3A and 3B, the depending rods 130 and 132 (or 140, or 143 of FIG. 8) are suspended from a particular datum point on the vehicle, such as 102 and 104 as shown. This depending arm is then connected to a horizontal measuring arm 134 at a distance "B" for example that represents the manufacturer's specification data of a distance "A" from a imaginary horizontal plane represented by the top of the measuring rod 134. In order to tell whether or not the vehicle at this particular point is exactly according to the manufacturer's specifications the depending rod 140 is positioned on the measuring rod 134 at the proper longitudinal alignment. Depending rods 140 and 142 will be contiguous to the inside of treadways 12 and 14. If not, then this will be an indication that either the vehicle is not centered and/or there is damage to be repaired to the vehicle body at this particular point.

The apparatus of this invention is capable of use with the measuring concepts of U.S. Pat. No. 5,058,286.

What is claimed is:

1. Apparatus for supporting, lifting, centering, measuring and repairing a damaged vehicle upon a vehicle body and frame straightening platform having spaced parallel treadways and force means to repair said vehicle wherein a top surface of said platform becomes a measuring datum plane to serve as a reference plane for measuring automobile frame and body alignment relative to a vehicle manufacturer's specifications, comprising:

measuring indicia upon said platform relative to said top surface of said platform for indicating a longitudinal centerline of said platform;

a plurality of pairs of vertically risible jacks, each pair comprising a first jack on one treadway and a second jack on an opposite treadway, means on each jack to attach to and to rigidly support said vehicle and means using said jacks to raise and lower said vehicle;

means to slide said jacks upon said treadways omnidirectionally whereby a longitudinal centerline of said vehicle is aligned with said longitudinal centerline of said platform; and means to attach said jacks to said platform.

2. Apparatus of claim 1 wherein said measuring indicia comprises:

depending rods connected to a vehicle fixturing means, said rods spaced apart slightly less than the space between said treadways, said rods depending below the top surface of each said treadway and thereby indicate when the longitudinal center line of said vehicle is above and substantially coincident with said longitudinal center line of said platform system.

3. Apparatus of claim 2 wherein said depending rods comprise;

a first pair of vertically depending gauge rods, each connected at one end to transversely spaced of said vehicle fixturing means;

a horizontal gauge rods;

means to adjustably connect said horizontal gauge rod with said first pair of vertically depending gauge rods so as to be horizontal to an undamaged portion of said vehicle body;

a second pair of vertically depending rods connected to said horizontal gauge rod so as to be spaced apart slightly less than said space between said treadways; said rods adapted to depend below the top surface of said treadways.

4. Apparatus of claim 3 wherein said gauge means comprises a measuring tape longitudinally attached to the treadways facing said space between said treadways.

5. Apparatus of claim 3 wherein said second pair of vertically depending rods are transparent with vertical measurement markings thereon.

6. Apparatus of claim 3 where in said gauge means comprises at least one measuring tape longitudinally attached to a removable longitudinal framework positioned atop and centered on the platform.

7. Apparatus of claim 1 wherein a top of said jack includes removable means to attach to said vehicle.

8. Apparatus for supporting, lifting, centering and repairing a damaged vehicle upon a vehicle body and frame straightening platform having spaced treadways and force means to repair said vehicle, comprising:

a plurality of pairs of vertically risible jacks, each pair comprising a first jack on one treadway and a second jack on an opposite treadway, means on each jack to attach to and to rigidly support said vehicle and means to raise, and to move said vehicle whereby said vehicle is centered relative to a longitudinal centerline above said platform system; and wherein said means to move said vehicle comprises a tie rod extending from each said jack to an opposite treadway, a slack adjustor attachable to said opposite treadway and adjustably attached to said tie rod.

9. Apparatus for supporting, lifting, centering and repairing a damaged vehicle upon a vehicle body and frame straightening platform having spaced treadways and force means to repair said vehicle, comprising:

a plurality of pairs of vertically risible jacks, each pair comprising a first jack on one treadway and a second jack on the opposite treadway, means on each jack to attach to and to rigidly support said vehicle and means to raise, and to move said vehicle whereby said vehicle is centered relative to a longitudinal centerline above said platform system; and wherein said means to move said vehicle comprises:

a tie rod for each said jack, said rod having a hook end and a chain end, a primary slack adjustor attached to a treadway opposite the jack, said hook end connected to one side of said jack, said chain end connected to said slack adjustor.

10. Apparatus of claim 9 further comprising a secondary slack adjustor attached to said treadway, means connecting between said secondary slack adjustor and at least one of said jacks.

11. Apparatus of claim 10 including tertiary slack adjustor attached to said treadway, means connecting between said tertiary slack adjustor and at least one of said jacks.

12. A method for supporting, lifting, centering, measuring and repairing a damaged vehicle comprising the steps of:

positioning a damaged vehicle on a platform, said platform having spaced parallel treadways and adjunct force means to repair said vehicle;

creating a top surface of said platform as a measuring datum plane to serve as a reference plane and longitudinal centerline for measuring alignment of vehicle frame and body datum points relative to a vehicle manufacturer's specifications;

clamping said vehicle to a plurality of pairs of vertically raisable jacks, each pair comprising a first jack on one treadway and a second jack on an opposite treadway;

raising said vehicle, using said jacks, above said platform;

sliding said jacks, and said clamped vehicle, upon said treadways until a longitudinal centerline of said vehicle is aligned with said longitudinal centerline of said platform;

locking said jacks to said platform;

measuring said vehicle frame and body datum points relative to said datum plane to determine the extent of damage and the corrective repair needed to return said vehicle to said manufacturer's specifications; and using said force means to make said corrective repair.

* * * * *